United States Patent [19]

Hobart

[11] 3,962,958

[45] June 15, 1976

[54] TUBE FORMER WITH WEAR INSERT

[76] Inventor: Jack Hobart, 24, Riversleigh Road, Leamington Spa, England

[22] Filed: Jan. 21, 1975

[21] Appl. No.: 542,815

[30] Foreign Application Priority Data

Jan. 24, 1974 United Kingdom ..... 3304/74

[52] U.S. Cl. ..... 93/20; 53/180 M; 93/82; 156/466

[51] Int. Cl.[2] ..... B31B 1/36; B31B 23/26; B65B 9/06

[58] Field of Search ..... 53/180, 182, 177, 191, 53/192; 93/14, 17, 18, 19, 20, 82, 84 TW; 156/203, 466

[56] References Cited

UNITED STATES PATENTS

| | | | |
|---|---|---|---|
| 3,122,072 | 2/1964 | Monsees et al. | 93/82 |
| 3,486,424 | 12/1969 | Tanner | 93/20 X |
| 3,636,826 | 1/1972 | Bowen et al. | 53/180 X |
| 3,785,112 | 1/1974 | Leasure et al. | 53/180 X |

*Primary Examiner*—Travis S. McGehee
*Assistant Examiner*—Horace M. Culver
*Attorney, Agent, or Firm*—Edward F. Connors

[57] ABSTRACT

A tube former, comprising a body and a wear insert which jointly define a preformer surface over which an elongate sheet of packaging material is to be pulled towards an edge of the preformer surface which defines an aperture through which the sheet is to be drawn at an acute angle to the preformer surface, the relative shape and positioning of the aperture and the preformer surface causing the longitudinal edges of the tube to overlap slightly, and the wear insert being detachably supported by the body and defining both said edge of the preformer surface and a continuous portion of the preformer surface lying immediately adjacent the edge.

3 Claims, 4 Drawing Figures

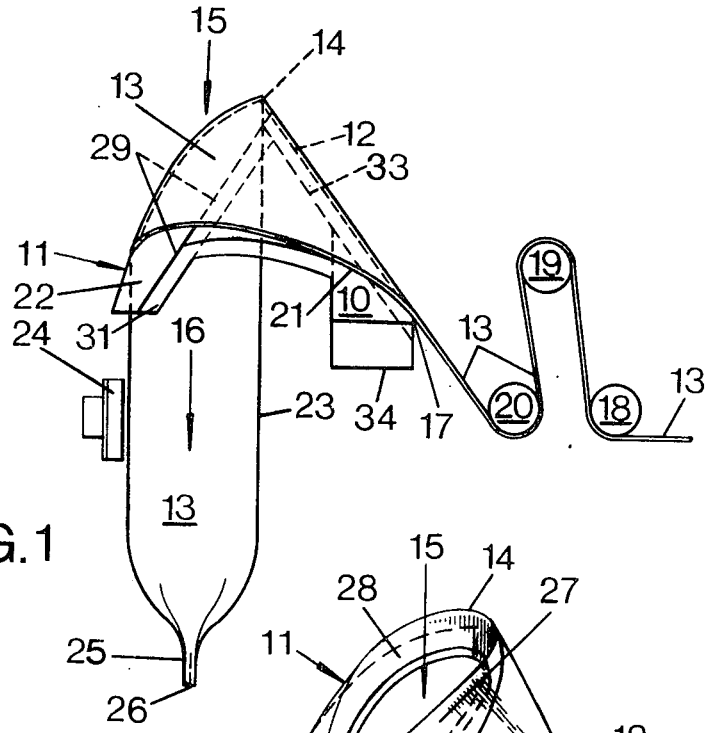
FIG. 1
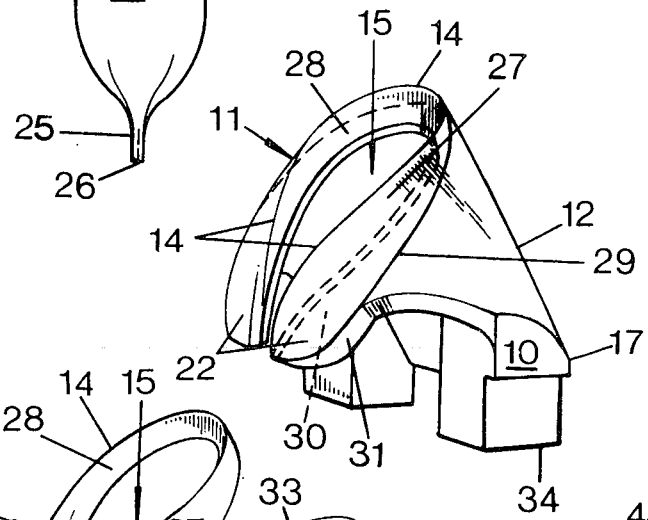
FIG. 2
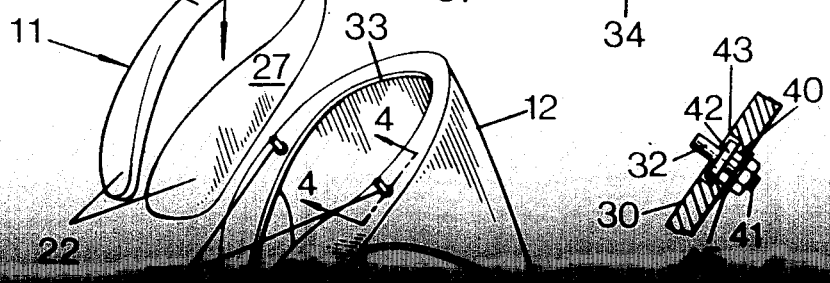

TUBE FORMER WITH WEAR INSERT

The invention relates to a former for manipulating an elongate sheet of packaging material into a tube and in particular, to such a former having a wear insert, and also to a replaceable wear insert for the former.

Such formers are commonly used in packaging machines of the form and fill type and usually comprise a preformer portion that is secured at an acute angle to an upright tubular support body, having an internal diameter corresponding closely with the external diameter of the tube which is to be formed. The sheet is drawn over the curved surface of the performer section and is then reversely directed through the tubular support body thereby manipulating the sheet into a tube having its longitudinal edges slightly overlapped. After passing through the tubular support body, these overlapped edges pass a stationary sealing head which causes them to adhere to each other. A transition line is defined by the intersection between the tubular support body and the preformer portion, and the transition line and the surface of the preformer portion are carefully designed so that the sheet is smoothly manipulated into a tube without tearing or crinkling. After the overlapped edges of the tube have been adhered together, the tube passes a transverse sealing and cutting head which is arranged to flatten the tube transversely, seal the opposite sides together, and then separate the tube transversely through the middle of the transverse seal. In this manner, the top of one bag and the bottom of an adjacent bag are formed simultaneously. Each bag is charged with product by discharging a predetermined quantity of the product into the top of the tubular support body so that the product will fall into the partly formed bag to be supported by the last made bottom seal. The product is then packed downwards by a stripping device before the next transverse seal is made to complete and separate the packed bag.

As the packaging material inherently has at least some degree of abrasiveness, the former is continually subjected to abrasion wherever it is touched by the moving packaging material. The rate of wear caused by such abrasion is dependent on the contact force between the packaging material and the former, and is highest in the region of the transition line marking the intersection between the tubular support body and the preformer portion. In view of the complex curvature of the former, it is an expensive item to replace, and it has already been proposed in British patent specification No. 1,203,684 to provide a tubular wear insert secured within the tubular support body so that its top edge defines the edge of the preformer surface and is subjected to the maximum rate of wear instead of the former. After the top edge of tubular wear insert has worn, the insert is then moved upwards to a new position. Due to the continuous operating cycle of a form and fill packaging machine using this type of former, it is difficult to assess the exact time when the machine should be stopped for repositioning the wear insert. As a result the top edge of the tubular wear insert can easily be worn down to the point at which the adjacent edge of the preformer surface is also being worn away. Also, when the tubular wear insert is adjusted to take account of wear that has occurred, its top edge will stand slightly proud of the preformer surface with the combined result of exposing the tubular wear insert to an unnecessarily high rate of wear and of causing an additional drag to be applied to the packaging material as it is pulled over this slight discontinuity. Furthermore, when a former is made in accordance with our copending patent application Ser. No. 542,813, (now U.S. Pat. No. 3,948,150) so that the former is relieved to allow the wall of the tube of packaging material to distort locally outwards for reducing the danger of feed blockages, it is generally inconvenient to mount a tubular wear insert within the former.

An object of this invention is to provide for a former, that manipulates an elongate sheet of packaging material into a tube, a replaceable wear insert which mitigates these disadvantages.

According to one aspect of the invention a former, for manipulating an elongate sheet of packaging material into a tube, comprises the combination of a body and a wear insert which jointly define a preformer surface over which the sheet is to be pulled, the preformer surface terminating in an edge which defines an aperture through which the sheet is to be drawn in a predetermined direction that is at an acute angle to the preformer surface, the aperture and the preformer surface being so shaped, and positioned relative to each other that the portion of the sheet passing through the aperture will be manipulated into a tube having its longitudinal edges overlapped, and the wear insert being detachably supported by the body and defining both the aforesaid edge of the preformer surface and a continuous portion of the preformer surface lying immediately adjacent the edge. The wear insert may also define a continuous portion of a surface within the aperture. Preferably, the body and the wear insert about on a generally flat surface which does not intersect the edge defining the aperture and is positioned so that the wear insert will be substantially symmetrical. Alternatively, the wear insert may be of substantially constant thickness and positioned in a corresponding rebate defined by the body. In that case, the wear insert may be cut from a sheet of wear resistant material. Otherwise, the wear insert may be formed as a moulding from wear resistant material.

The body and/or the wear insert may be so shaped adjacent the aperture that the wall of the tube of packaging material may locally be distorted outwardly without engaging the body and/or wear insert as appropriate. In such a case the body of the former preferably defines mounting means which is positioned remote from the aperture and is arranged to secure the body to a packaging machine. The body of the former may be made of sheet material, in which case the body may define a flange which is turned away from the preformer surface to provide said mounting. Alternatively, the body may be formed as a casting.

Alternatively, the body may be supported by a tubular support thrugh which the tube of packaging material is to pass, and the tubular support is secured to the body at a point which is spaced from the edge defining the aperture.

If desired adjustable locating means may be provided for locating the wear insert relatively to the body.

According to another aspect of the invention a former wear insert, which is to be detachably supported by the body of a former for manipulating an elongate sheet of packaging material into a tube by pulling the sheet over a preformer surface towards an edge defining an aperture and by drawing the sheet through the aperture in a predetermined direction that is at an acute angle to the preformer surface, may define both the aforesaid wear insert is substantially symmetrical and defines a generally flat surface for abutting the body. Alternatively the wear insert may be of substantially constant thickness measured from its surface defining the portion of the preformer surface, and is to be positioned within a corresponding rebate defined by the body. In that event, the wear insert may be cut from a sheet of wear resistant material. Alternatively, the wear insert can be formed as a moulding from wear resistant material.

The invention will now be described, by way of example only, with reference to the accompanying drawings, in which:

FIG. 1 is a diagrammatic side elevation showing one kind of former which comprises a body and a replaceable wear insert and is being used for manipulating an elongate sheet of packaging material into a tube;

FIG. 2 is a perspective view of the former shown in FIG. 1;

FIG. 3 is an exploded perspective view of another former comprising the same design of wear insert in combination with a different body, and FIG. 4 is a part cross-sectional view of the former shown in FIG. 3 on the line 4—4 in FIG. 3.

In the drawings, the former comprises a body 10 and a replaceable wear insert 11 which jointly define a preformer surface 12 for supporting one side of a sheet 13 of pre-printed transparent packaging film. The top edge 14 of the preformer surface defines an aperture 15 through which the sheet 13 is to be drawn in the direction of arrow 16. The preformer surface 12 is shaped so that it curves progressively from its straight bottom edge 17 towards the top edge 14 as shown.

The sheet of packaging film 13 is of constant width and is conveniently stored on an unshown roll from which it is led through various rollers 18, 19 and 20 which serve generally to straighten the sheet and to apply a predetermined tension to it. The roller 20 is positioned so that the sheet 13 is led smoothly over the bottom edge 17 of the preformer surface 12. As the sheet 13 moves upwardly over the preformer surface 12, its longitudinal edges (of which one is shown at 21) are progressively curved first downwardly relative to the middle of the sheet, and are then moved towards each other due to their engagement with two wing areas 22 of the preformer surface 12. On reaching the top edge 14, the sheet 13 is subjected to an abrupt change of direction and is effectively turned inside out. It will be noted that the new direction 16, in which the sheet 13 is constrained to pass through the aperture 15, is at an acute angle to the plane of the preformer surface 12. The profile of the top edge 14 and the curvature of the preformer surface 12 are shaped and positioned relative to each other, in a manner well known in the art, so that the portion of the sheet passing through the aperture 15 will be manipulated as shown into a tube 23. The longitudinal edge 21 slightly overlaps the opposite longitudinal edge of the former sheet, and these overlapped edges pass a stationary sealing head 24 which causes them to adhere to each other in a manner also well known in the art. After the overlapped edges of the tube 23 have been adhered together, the tube passes an unshown transverse sealing and cutting head which can be arranged in known manner to cut 26. The partially completed bag 23 shown in FIG. 1 is now charged with product, such as potato crisps, by discharging a predetermined weight of the product into the aperture 15. The product can then be packed downwards in known manner by a stripping device before the bag is sealed and separated from the newly generated partially completed bag.

The replaceable wear insert 11 is shaped, as best seen in FIGS. 2 and 3, so that it defines the whole edge 14 of the aperture 15, and also defines a continuous portion 27 of the preformer surface immediately adjacent the edge 14 and a corresponding continuous surface 28 within the aperture 15. The junction 29 between the body 10 and the wear insert 11 is preferably planar so that the under surface of the wear insert 11 is flat and rests on a corresponding surface 30 defined by the body 10. In order to support the portions of the wear insert 11 that define the wings 22, the body 10 is formed with projecting lips 31. As shown in the drawings, the planar junction 29 is positioned to be substantially parallel to the edge 14 so that wear insert 11 is symmetrical. However, the position of the junction 29 can be altered if so desired. The wear insert 11 can be secured to the body 10 in any convenient manner provided that the portion 27 of the preformer surface is properly aligned with the remainder of the preformer surface 12. For instance, as shown in FIG. 3, the wear insert can be a push fit onto two coacting pegs 32 carried by the body 10 at right angles to the surface 30. As shown in FIG. 4, each peg 32 passes through an oversize aperture 40 formed in the surface 30. One end of the peg 32 is formed with a screw thread 41 and the peg has an annular flange 42 positioned intermediate its ends. The flange 42 locates in an oversize counterbore 43. After the wear insert 11 has been located on the pegs 32, the position of the wear insert 11 relatively to the surface 30 can be adjusted slightly until the wear insert occupies its correct position. Each peg 32 can then be clamped in position by means of a nut 44 and washer 45. With such an arrangement, it is unnecessary to position locating sockets for the pegs 32 in the wear insert 11 with great accuracy. Adjustable pegs 32 may also be provided on the body 10 shown in FIGS. 1 and 2.

Thus the wear insert 11 defines the area of the former over which the majority of wear is liable to take place, with the result that any wear of the edge 14 will be accompanied by a correspondingly graduated wear up to the edge 14. When the wear insert 11 has suffered wear of a predetermined level, it is readily replaced by a similar wear insert which can be quickly assembled in the correct position relative to the body 10 without any substantial adjustments being necessary. The wear insert 11 is conveniently formed by moulding which term is used to embrace casting processes, and can be formed of a suitable wear resistant plastic material having a low coefficient of friction such as nylon, polytetrafluoroethylene, or one of the polysilicones. Alternatively the wear insert 11 could comprise a rigid base covered with a wear resistant layer of one of the aforementioned materials or with a suitable ceramic material or chromium alloy.

The body 10 of the former shown in FIGS. 1 and 2 is made as a light alloy casting of the shape shown, the preformer surface 12 being carefully machined and finished up to the junction 29 to provide a smooth surface for supporting the sheet of packaging film. As taught in our copending patent application Ser. No. 542,813 (now U.S. Pat. No. 3,948,150) the body 10 is relieved at 33 to prevent any of the product discharged through the aperture 15 from causing a feed blockage by bridging across the partially completed bag 23 within the aperture 15. In this manner, any product tending to bridge across the partially completed bag 23 merely causes the tube to be distorted outwardly in that locality and, due to the inherently flimsy nature of the packaging film, the product then slides smoothly downwards towards the bottom seal 25. In contradistinction, previously proposed formers have a tubular support body closely surrounding the tube 23 thereby preventing any significant outward distortion of the tube 23. Adjacent the bottom edge 17 of the preformer surface 12, the casting is enlarged to provide a mounting flange 34 by which it is to be secured to the packaging machine. By arranging this mounting flange remote from the aperture 15 and outside the relieved area 33, the mounting of the former does not restrict the sides of the partly formed tube 23 as has been the case with previously proposed formers having a tubular support body closely surrounding the tube 23.

FIG. 3 shows an alternative construction of the body 10 which is fabricated from sheet metal such as stainless steel. Conveniently, the sheet defining the preformer surface 12 is turned away from the preformer surface to provide a mounting flange 35.

In those cases in which the product to be discharged through the aperture 15 is not liable to cause feed blockages, or where such blockages are so seldom as to be acceptable, the body 10 may if desired be carried by the previously proposed tubular support body which closely surrounds the tube 23. However it will be necessary, if the replaceable wear insert 11 is of the form illustrated, for the top of the tubular support body to terminate flush with the surface 30.

The constructions illustrated in the drawings have additional advantages in that the most intricately shaped parts of the former are now defined by the wear insert 11 which can be mass-produced to a very high standard of accuracy by moulding.

Instead of being formed to the shape shown in the drawings, the wear insert 11 can be formed of a substantially constant thickness measured from its surface 27, the body 10 being formed with a corresponding rebate for receiving the insert. By employing this construction, the wear insert 11 can be conveniently cut from a strip of suitable wear resistant material or can be moulded as previously described. A wear insert formed in this manner would define the surface 27 and the edge 14, but the width of the surface 28 would be limited by the thickness of the wear insert.

What I claim as my invention and desire to secure by Letters Patent of the United States is:

1. A former, for manipulating an elongate sheet of packaging material into a tube, comprising the combination of a body and a wear insert, a preformer surface jointly defined by said body and said wear insert over which the sheet is to be pulled, the preformer surface terminating in an edge, said edge defining an aperture through which the sheet is to be drawn in a predetermined direction that is at an acute angle to the preformer surface, the aperture and the preformer surface being so shaped and positioned relative to each other that the portion of the sheet passing through the aperture will be manipulated into a tube having its longitudinal edges slightly overlapped, the wear insert being detachably supported by the body and defining both the aforesaid edge of the preformer surface and a continuous portion of the preformer surface lying immediately adjacent the edge, the wear insert also defining a continuous portion of a surface within the aperture, and the body and the wear insert abutting on a generally flat surface which does not intersect the edge defining the aperture and is positioned so that the wear insert will be substantially symmetrical.

2. A former, for manipulating an elongate sheet of packaging material into a tube, comprising the combination of a body and a wear insert, a preformer surface jointly defined by said body and said wear insert over which the sheet is to be pulled, the preformer surface terminating in an edge, said edge defining an aperture through which the sheet is to be drawn in a predetermined direction that is at an acute angle to the preformer surface, the aperture and the preformer surface being so shaped and positioned relative to each other that the portion of the sheet passing through the aperture will be manipulated into a tube having its longitudinal edges slightly overlapped, the wear insert being detachably supported by the body and defining both the aforesaid edge of the preformer surface and a continuous portion of the preformer surface lying immediately adjacent the edge, the wear insert also defining a continuous portion of a surface within the aperture, the body and the wear insert abutting on a generally flat surface which does not intersect the edge defining the aperture and is positioned so that the wear insert will be substantially symmetrical, and adjustable locating means comprising peg means movable in a plane substantially parallel with said generally flat surface for locating the wear insert relatively to the body.

3. A former wear insert for manipulating an elongate sheet of packaging material into a tube, comprising a preformer surface portion terminating in an edge defining an aperture through which the sheet is to be drawn in a predetermined direction that is at an acute angle to the preformer surface portion, the aperture and the preformer surface portion being so shaped and positioned relative to each other that the portion of the sheet passing through the aperture will be manipulated into a tube having its longitudinal edges slightly overlapped, said wear insert defining a surface arranged to abut a former body such that the preformer surface portion of said insert will define a continuous portion of a preformer surface defined by said former body, said insert being substantially symmetrical and said surface arranged to abut the former body being generally flat.

* * * * *